US008927840B2

(12) United States Patent
Griego et al.

(10) Patent No.: US 8,927,840 B2
(45) Date of Patent: Jan. 6, 2015

(54) VARIABLE MECHANICAL ACOUSTIC RESONANCE COMPONENT FOR MUSICAL INSTRUMENT USING DEFINED RESONANCE INDEX

(76) Inventors: Elias Christan Griego, Elkhorn, WI (US); Charlie McCoy, Eagle, WI (US)

( * ) Notice: Subject to any disclaimer, the term of this patent is extended or adjusted under 35 U.S.C. 154(b) by 784 days.

(21) Appl. No.: 12/854,478

(22) Filed: Aug. 11, 2010

(65) Prior Publication Data

US 2012/0036979 A1 Feb. 16, 2012

(51) Int. Cl.
*G10D 9/02* (2006.01)
*G10D 7/10* (2006.01)

(52) U.S. Cl.
CPC . *G10D 9/026* (2013.01); *G10D 7/10* (2013.01)
USPC ..... 84/398

(58) Field of Classification Search
USPC ..... 84/380 R, 453, 398, 399, 387 R
See application file for complete search history.

(56) References Cited

U.S. PATENT DOCUMENTS

| | | | | |
|---|---|---|---|---|
| 3,964,363 | A * | 6/1976 | Armento | 84/399 |
| 4,962,007 | A | 10/1990 | Phelan | |
| 5,192,821 | A | 3/1993 | Goldstein et al. | |
| 5,578,775 | A | 11/1996 | Ito | |
| 5,847,300 | A * | 12/1998 | Hackl | 84/398 |
| 6,124,538 | A | 9/2000 | Landell | |
| 6,940,007 | B2 | 9/2005 | Schmidt | |
| 7,560,631 | B1 * | 7/2009 | John et al. | 84/398 |
| 2005/0079371 | A1 | 4/2005 | Guo | |

* cited by examiner

*Primary Examiner* — Kimberly Lockett
(74) *Attorney, Agent, or Firm* — Absolute Technology Law Group, LLC

(57) ABSTRACT

The present invention is a variable mechanical acoustic resonance component for a musical instrument and a method for producing a variable mechanical acoustic resonance component comprising of at least two segments, each segment having distinct resonance and tone properties dependant on the properties of the segment as specified in a resonance index.

14 Claims, 6 Drawing Sheets

| Material or Composite Ratios | Thickness | Hardness | Density | Surface Area | Resonance and Tone Qualities | Other Factors | Composite Index for Particular Tonal Property |
|---|---|---|---|---|---|---|---|
| Brass (10%) and Aluminum (90%) | | | | | | | |
| Aluminum (90%) and Brass (10%) | | | | | | | |
| Brass (90%) and Aluminum (10%) | | | | | | | |
| Aluminum (10%) and Brass (90%) | | | | | | | |
| Copper (30%) and Aluminum (70%) | | | | | | | |
| Aluminum (70%) and Copper (30%) | | | | | | | |
| Aluminum (30%) and Copper (70%) | | | | | | | |
| Copper (70%) and Aluminum (30%) | | | | | | | |
| Copper (40%) and Copper (60%) | | | | | | | |
| Copper (60%) and Copper (40%) | | | | | | | |

Figure 1a

VARIABLE MECHANICAL ACOUSTIC RESONANCE COMPONENT FOR MUSICAL INSTRUMENT USING DEFINED RESONANCE INDEX

FIELD OF INVENTION

The present invention relates to the field of mechanical acoustic musical instruments, and specifically to segmented structural components for musical instruments (e.g., mouthpieces, brass instrument ferrules).

BRIEF DESCRIPTION OF THE DRAWINGS

FIG. 1*a* is an exemplary resonance index for classifying materials from which instrument segments may be constructed.

GLOSSARY

Figure 1C:
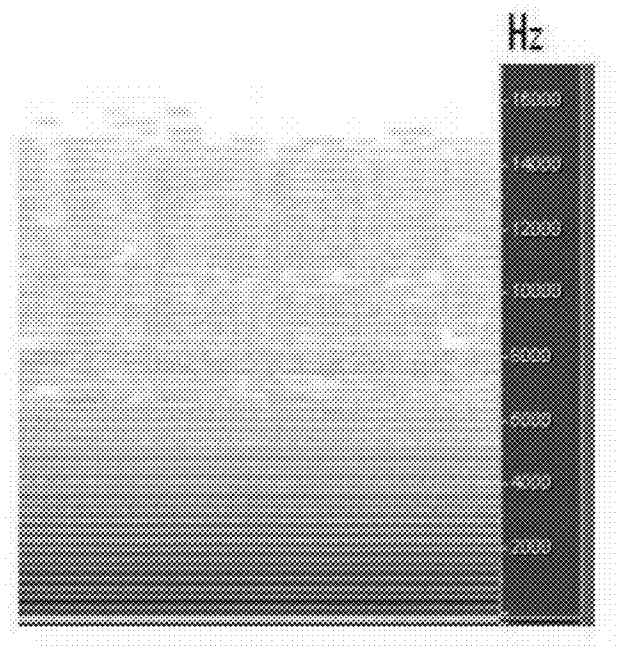
FIGS. 1*b*, 1*c* and 1*d* are exemplary sound analysis graphs which may be used to determine values for a resonance index.

As used herein, the term "acoustic resonance" or "mechanical acoustic resonance" means intensification and prolongation of sound, especially of a musical tone, produced by sympathetic vibration. Acoustic resonance with a frequency range of between 12 Hz and 20 kHz (20,000 Hz) is within the range of human hearing. Resonance is the measurable physical phenomena which affects tonal quality.

As used herein, the term "base structure" means a structure comprised of at least two segments of mechanically resonating material and formed into at least one component of a musical instrument.

As used herein, the term "base structure resonating quality" means the resonance of a base structure as determined by the resonance of two or more segments from which the bases structure is constructed.

As used herein, the term "density" means the mass of a material per unit volume.

As used herein, the term "hardness" refers to how resistant a material is to indentation and deformation when a force is applied and is indicated using the Brinell hardness number, Knoop hardness, Rockwell scale or other means known in the art to measure hardness.

As used herein, the term "integrally connected" means structurally integrated materials machined to form a single functional unit.

As used herein, the term "machining" includes lathing, brazing, forging, sintering, stamping, winding and extruding processes known in the art. Machining, as used herein, may also include welding, soldering and adhering of materials, as well as any other manufacturing process known in the art which may be used for the formation of a musical instrument component.

As used herein, the term "material ratio" refers to the proportion of one material relative to another material within a structure, which may be expressed by any alpha-numeric representation (e.g., the ratio of a segment of one material to a segment of another material). A material ratio may further be used to indicate order and placement of materials.

As used herein, the term "mechanically resonating material" means a material capable of absorbing more energy when the frequency of oscillations matches the material's natural frequency of vibration than at other frequencies.

As used herein, the term "resonance graphing instrument" means any hardware or software tool capable of measuring and representing resonance qualities of materials.

As used herein, the term "resonance index" means a numeric representation which identifies resonance qualities of a material.

As used herein, the term "resonance quality" means a physical characteristic which effects resonance including, but not limited to, thickness, hardness, density and surface area.

As used herein, the term "segment" means a physical portion of a base structure comprised of one or more identifiable resonating materials. A segment may be constructed of any solid material, alloys, wires or other structure and/or substance known in the art.

As used herein, the term "sound analysis graph" refers to a graphical representation created by a resonance graphing instrument that can be used to measure and compare resonance and tonal characteristics.

As used herein, the term "thickness" refers to the dimension between two surfaces of an object or material.

As used herein, the term "tone" refers to a quasi-unique sound produced by a particular instrument based upon its measurable resonance, and which is an aesthetic quality which may be subjectively perceived.

BACKGROUND

When a person strikes, strums, plucks or otherwise initiates a vibration of the air space within a musical instrument, the sound waves are amplified when the vibration matches the instrument's natural frequency. There may be one or more natural frequencies, and each natural frequency of an instrument is associated with a standing wave pattern by which the air space inside the instrument could vibrate. These natural frequencies are also called the harmonics of an instrument.

An instrument may be forced into vibrating at a harmonic when an interconnected object pushes with one of the instrument's natural frequencies. This is known as acoustic resonance.

Acoustic resonance is dependent on the shape, size and length of the air space within the musical instrument, and on the material from which the instrument is made. The material from which the instrument is made will also affect the instrument's tone.

For example, most brass instruments and mouthpieces today are made from one of five materials: gold plated brass, silver plated brass, plastic, stainless steel and titanium. Gold plating is expensive, but produces a rich, full, dark tone. Silver plating, while cheaper than gold, produces a clearer, brighter tone. Stainless steel and titanium are also expensive materials, but, because brass may absorb vibration, offer tone qualities not available with plated brass. Finally, plastic is affordable, but has a diminished tone quality. Most plastic instrument components are used primarily outdoors, such as when marching.

The resonance and tone of a drum, such as a timpani, is also dependent on the material from which the bowl is made. Timpani bowls are usually made from copper, fiberglass or aluminum. Copper, the most expensive, produces a darker, richer tone that is not achieved with fiberglass or aluminum, which tend to sound tinny and thin.

It is desirable to produce components for musical instruments that are durable and produce desired tone qualities.

It is desirable to produce components for musical instruments that combine tone and resonance qualities of different materials.

It is desirable to develop a method to produce components for musical instruments that integrate two or more materials with distinct resonance qualities.

SUMMARY OF THE INVENTION

The present invention is a structural component and a method of making a structural component which is comprised of at least two segments of mechanically resonating materials capable producing distinct resonance qualities which can be measured and depicted using a resonance graphing instrument known in the art.

DETAILED DESCRIPTION OF INVENTION

For the purpose of promoting an understanding of the present invention, references are made in the text to exemplary embodiments of mechanical acoustic resonance components and methods for producing mechanical acoustic resonance components, only some of which are described herein. It should be understood that no limitations on the scope of the invention are intended by describing these exemplary embodiments. One of ordinary skill in the art will readily appreciate that alternate but functionally equivalent materials and methods may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale, instead emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1*a* is an exemplary resonance index table for materials which can be used for segments which can be constructed to alter physically measurable resonance to achieve desired tonal effects. Material or composite ratios are defined in column 1. In the exemplary embodiment, each ratio expresses the percentage composition, and relative location of the material is indicated by whether the material is listed first, second or last. For example, the second row of FIG. 1*a* includes the material or composite ratio of "Brass (10%) and Aluminum (90%)." This ratio indicates that a component is made from 10% brass and 90% aluminum, with the brass segment occurring at the front (or top) of the instrument component and the aluminum segment occurring at the back (or bottom) of the instrument component. In alternate embodiments, different alpha-numeric representations, codes and quasi-unique identifiers may be used to express resonance qualities which in turn may be used to alter tonal qualities consistent with subjective user preferences.

Columns 2-7 of FIG. 1*a* may include specific ratio values for resonance qualities of the mechanically resonating materials indicated with the material ratios indicated in column 1. These resonance qualities may vary significantly, and resonance indices may be created specifically for mechanically resonating materials of a specific thickness, hardness, density and surface area. A collection of resonance indices may therefore be compiled.

The final column may indicate a composite index that incorporates the values from columns 2-7.

Figure 1B:
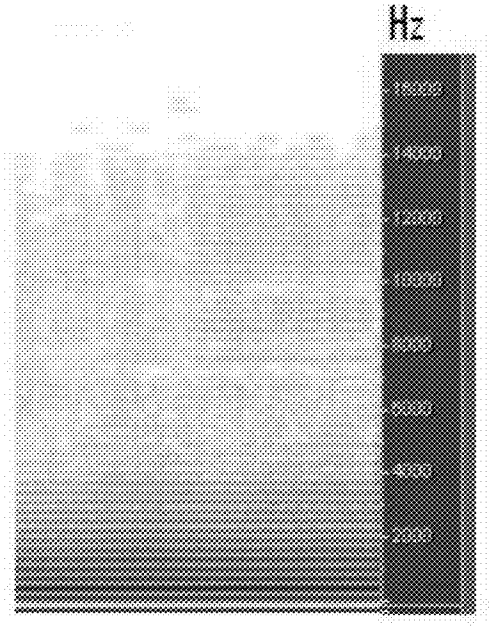
Figure 1D:
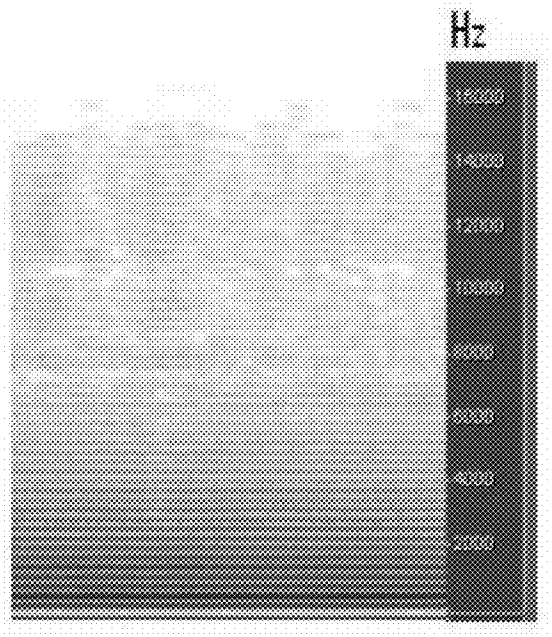

FIGS. 1*b*, 1*c* and 1*d* are exemplary embodiments of sound analysis graphs which may be used in completing a resonance index. In the exemplary embodiments shown in FIGS. 1*b*, 1*c*, and 1*d*, each column represents a note played by an instrument, and the frequencies recorded and measured for each note are displayed. Frequency values are defined along the y-axis. The frequencies recorded and measured for each note vary depending on the number of segments from which a base structure is made and the resonance qualities of the mechanically resonating materials from which the segments are made.

By comparing sound analysis graphs for base structures with varying numbers of segments and mechanically resonating materials with varying resonance qualities, base components may be created with desired resonance and tonal characteristics.

Figure 2A:
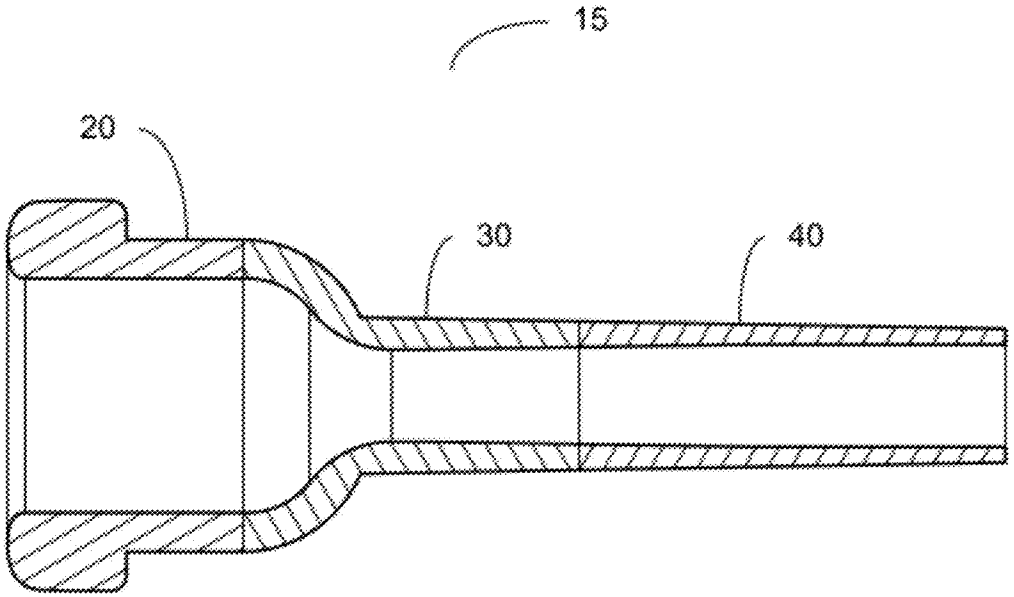
FIG. 2*a* is an exemplary embodiment of a mouthpiece for a brass instrument.

FIG. 2*a* is an exemplary embodiment of a trumpet mouthpiece 15. In this exemplary embodiment, mouthpiece 15 is a base structure, created using multiple segments 20, 30 and 40, each having a measurable resonating index. The resonance of each of segments 20, 30 and 40 may be affected by the physical characteristics of thickness, hardness, density and surface area, which may also be assigned a numeric value or index based on a physical measurement standard.

Figure 2B:
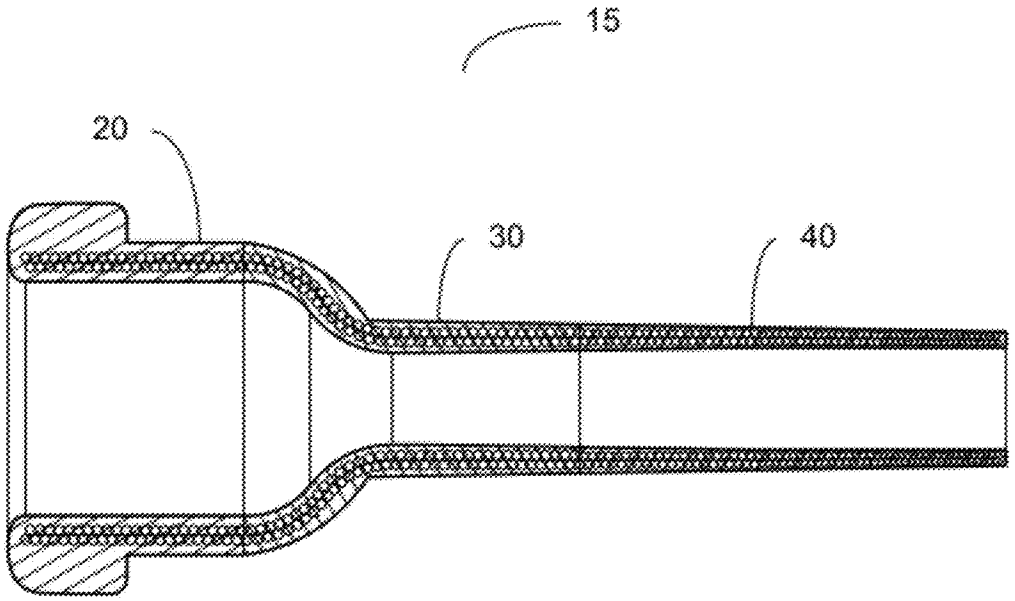
FIG. 2*b* is an exemplary embodiment of a mouthpiece for a brass instrument in which segments are constructed of one or more wires.

FIG. 2*b* is an exemplary embodiment of trumpet mouthpiece 15, wherein segments 20, 30 and 40 are constructed of one or more wires.

In the exemplary embodiment shown in FIGS. 2*a* and 2*b*, the combination of segments 20, 30 and 40, each constructed of a different mechanically resonating material, creates an instrument having a unique resonance and tone affected by the combined resonance of the segments.

In various other embodiments, mouthpiece 15 may be comprised of more or fewer segments, and segments 20, 30 and 40 may be different or the same materials. Segments 20, 30 and 40 may also be of varying thicknesses or surface areas. Segments and specific dimensions are calculated and defined (e.g., using a resonance index table) as shown in FIG. 1*a* to quantify desired resonance and tone qualities such as brightness, darkness, deepness, lightness and smoothness.

Figure 3:
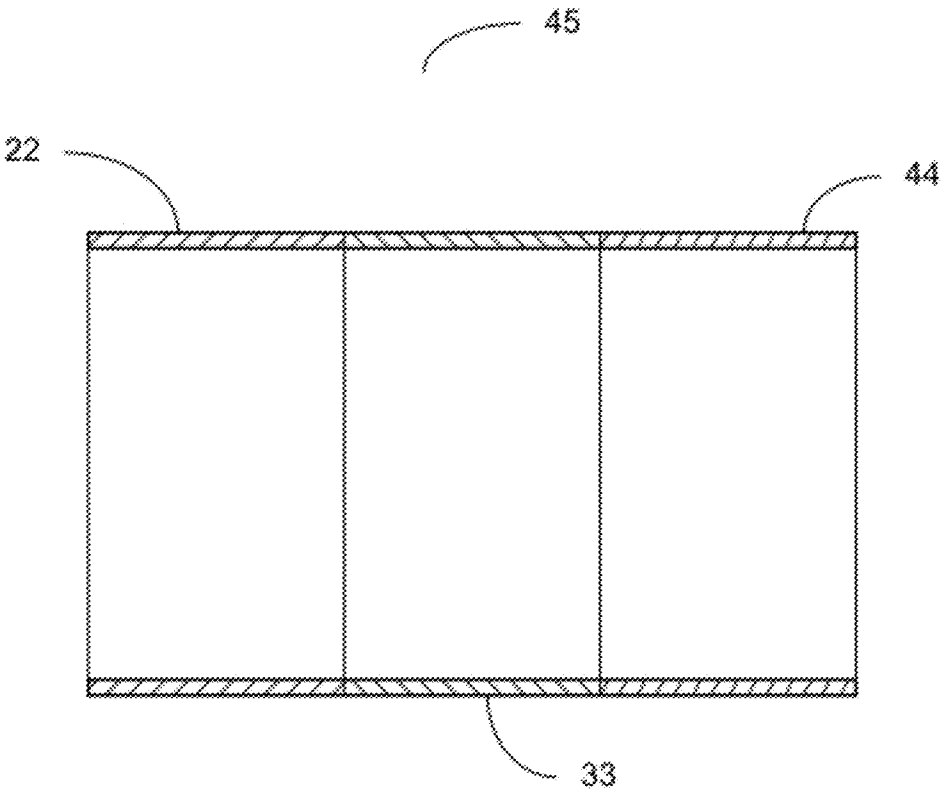
FIG. 3 is an exemplary embodiment of a brass instrument ferrule.

FIG. 3 is an exemplary embodiment of a ferrule 45. In this embodiment, ferrule 45 is created using multiple segments 22, 33 and 44, each having a measurable resonating index. The resonance of each of segments 22, 33 and 44 may be affected by the physical characteristics of thickness, hardness, density and surface area, which may also be assigned a numeric value or index based on a physical measurement standard.

In the exemplary embodiment shown in FIG. 3, the combination of segments 22, 33 and 44, each constructed of a different mechanically resonating material, creates an instrument having a unique resonance and tone affected by the combined resonance of the segments.

In various embodiments, ferrule 45 may be comprised of more or fewer segments, and segments 22, 33, and 44 may be different or the same mechanically resonating materials. Segments 22, 33, and 44 may also be of varying thicknesses or surface areas. Segments and specific dimensions are calculated and defined (e.g., using a resonance index table) as shown in FIG. 1*a* to quantify desired resonance and tone properties such as brightness, darkness, deepness, lightness and smoothness.

To produce base structures for musical instruments using multiple segments of mechanically resonating materials, the distinct resonating qualities of at least to mechanically resonating materials must be determined. Once at least two segments of mechanically resonating materials having desired resonance and tone properties have been found, a base structure for a musical instrument comprised of at least two segments must be machined. The resulting base structure will have the desired resonance and tonal properties from the chosen segments. The base structure may then be joined to the musical instrument.

What is claimed is:

1. An apparatus for a musical instrument comprised of:

a single component base structure comprised of at least two segments, wherein each segment is comprised of a preselected mechanically resonating material defined by a look-up table indexing materials having a predefined resonance which is different from all other said at least two segments from which said base structure is comprised; and wherein each segment is integrally connected to form said single musical instrument component.

2. The apparatus of claim 1 wherein said musical instrument component is a mouthpiece.

3. The apparatus of claim 1 wherein said musical instrument component is a ferrule.

4. The apparatus of claim 1 wherein said resonance of said at least two segments is controlled by varying the material from which a segment is constructed.

5. The apparatus of claim 1 wherein said resonance of said at least two segments is controlled by varying size of a segment.

6. The apparatus of claim 1 wherein each of said at least two segments produces a tonal quality which is distinct from the tonal quality of other segments.

7. The apparatus of claim 1 wherein each of said at least two segments has at least ones structural characteristic which may be varied to effect resonance, said structural characteristic selected from a group consisting of thickness, surface area, hardness, and density.

8. The apparatus of claim 1 wherein each of said at least two segments may be associated with resonating indices which may be graphically depicted.

9. The apparatus of claim 1 wherein said at least one mechanically resonating material has a graphical range of 20 Hz to 20 kHz.

10. The apparatus of claim 1 wherein said single component base structure is a mouthpiece for a brass musical instrument.

11. The apparatus of claim 1 wherein said single component base structure is a mouthpiece for a brass musical instrument selected from a group consisting of a trombone, a bass trombone, an alto trombone, a soprano trombone, a French horn, a trumpet, a bass trumpet, a tuba, a euphonium, a coronet, a flugelhorn, and a piccolo trumpet.

12. The apparatus of claim 1 wherein said mechanically resonating material is selected from a group consisting of metal, pure metal, alloy, ceramic, carbon, polycarbons and combinations thereof.

13. The apparatus of claim 1 wherein a segment may be constructed of wire.

14. The apparatus of claim 13 wherein said wire is constructed of multiple materials.

* * * * *